US010316669B2

(12) United States Patent
Romero et al.

(10) Patent No.: US 10,316,669 B2
(45) Date of Patent: Jun. 11, 2019

(54) REINFORCEMENT FOR THE LEADING EDGE OF A TURBINE ENGINE BLADE

(71) Applicant: Safran Aircraft Engines, Paris (FR)

(72) Inventors: Jean-Louis Romero, Moissy-Cramayel (FR); Jean-François Frerot, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 37 days.

(21) Appl. No.: 15/794,765

(22) Filed: Oct. 26, 2017

(65) Prior Publication Data

US 2018/0119551 A1 May 3, 2018

(30) Foreign Application Priority Data

Oct. 28, 2016 (FR) ..... 16 60479

(51) Int. Cl.

| | |
|---|---|
| ***F01D 5/14*** | (2006.01) |
| ***F01D 5/28*** | (2006.01) |
| ***F01D 21/04*** | (2006.01) |
| ***F04D 29/32*** | (2006.01) |
| *F04D 29/38* | (2006.01) |

(52) U.S. Cl.

CPC ..... *F01D 5/147* (2013.01); *F01D 5/282* (2013.01); *F01D 5/288* (2013.01); *F01D 21/045* (2013.01); *F04D 29/324* (2013.01); *F04D 29/388* (2013.01); *F05D 2220/36* (2013.01); *F05D 2240/303* (2013.01); *F05D 2250/711* (2013.01); *F05D 2300/133* (2013.01)

(58) Field of Classification Search

CPC ... F01D 5/14; F01D 5/28; F01D 5/147; F01D 5/282; F01D 5/288; F01D 21/045; F04D 29/324; F04D 29/388; F05D 2220/36; F05D 2240/303; F05D 2250/711; F05D 2300/133

See application file for complete search history.

(56) References Cited

U.S. PATENT DOCUMENTS 3,809,494 A * 5/1974 Redman ..... F01D 5/189 415/115

FOREIGN PATENT DOCUMENTS

| | | |
|---|---|---|
| EP | 2 540 974 A2 | 1/2013 |
| GB | 2 298 653 A | 9/1996 |

* cited by examiner

*Primary Examiner* — Hieu T Vo

(74) *Attorney, Agent, or Firm* — Blank Rome LLP

(57) ABSTRACT

A turbine engine blade comprising an aerodynamic surface that extends in a first direction between a leading edge and a trailing edge, and in a second direction substantially perpendicular to the first direction between a root and a tip of the blade, and a leading-edge reinforcement comprising a fin partly covering the aerodynamic surface of the blade, characterised in that the fin has a radially outer edge arranged in the vicinity of the tip of the blade and extending between the leading edge and the trailing edge, this radially outer edge comprising an upstream point fitting flush with the tip of the blade at the leading edge and a so-called downstream point separated from the tip of the blade.

10 Claims, 3 Drawing Sheets

REINFORCEMENT FOR THE LEADING EDGE OF A TURBINE ENGINE BLADE

CROSS-REFERENCE TO RELATED APPLICATIONS

This application claims the benefit of French Patent Application 1660479, filed Oct. 28, 2016, the contents of which is incorporated herein by reference.

FIELD OF THE INVENTION

The present invention relates to a turbine engine blade, and more particularly to a reinforcement for the leading edge of such blade. Blade means here both the moving blades and the fixed blades of turbine engines.

BACKGROUND

In order to increase the resistance of blades to FOD (foreign object damage) in the airflow, that is to say to foreign bodies such as birds and hailstones, they comprise a leading-edge reinforcement, the role of which is to protect the leading edge from damage during impact with an FOD and to distribute the impact force over a large surface area of the blade.

A reinforcement for the blade leading edge conventionally comprises a suction-face fin at least partially covering the aerodynamic suction-face surface of the blade and a pressure-face fin at least partially covering the aerodynamic pressure-phase surface of the blade, these two fins being joined by a leading edge of the reinforcement.

When the blade is able to move with respect to the axis of the turbine engine, it turns its pressure-face surface to the front, that is to say the air comes into contact on the pressure-face surface, thus creating an overpressure on the pressure-face surface and a negative pressure on its suction-face surface.

The impact of an FOD on the leading-edge reinforcement has a tendency to cause a detachment of the upper portion of the pressure-face fin. Beyond a certain mass of FODs, the force of the impacts is greater on the reinforcement, which is also causes a detachment of the upper portion of the suction-face fin. The overpressure generated on the pressure-face tends to limit the detachment of the pressure-face fin to the pressure face. On the other hand, the combination of centrifugal force, greater at the blade tip than at the root, with the negative pressure generated on the suction face, tends to promote the detachment of the suction-face fin.

When the blade is a fan blade mounted in an external fairing carrying an internal abradable layer facing the blades, the detachment of the suction-face fin causes damage to the internal abradable layer. This is because the suction-face fin projects from the suction face of the blade and penetrates the internal abradable layer, which creates a furrow in the internal abradable layer. It is then necessary to immobilise the turbine engine in order to replace both the blade the leading-edge reinforcement of which has detached and the internal abradable layer. Such a mobilisation gives rise to a high cost resulting from the lack of operation of the turbine engine, which it is important to reduce or even eliminate.

SUMMARY

The aim of the invention is in particular to afford a simple, effective and economical solution to this problem.

To this end, the invention proposes, firstly, a turbine engine blade extending along a longitudinal axis, comprising an aerodynamic surface that extends in a first direction between a leading edge and a trailing edge, and in a second direction substantially perpendicular to the first direction between a root and tip of the blade, and a leading-edge reinforcement comprising a fin partly covering the aerodynamic surface of the blade, characterised in that the fin has a radially outer edge arranged in the vicinity of the tip of the blade and extending between the leading edge and the trailing edge, this radially outer edge comprising an upstream point fitting flush with the tip of the blade at the leading edge and a downstream point distant from the tip of the blade.

The spacing of the downstream point from the top edge of the suction-face fin makes it possible to limit the penetration of the fin in the internal abradable layer of the turbine engine, in the event of detachment of the downstream point of the blade, since it is then distant from the abradable part because of its distance during the mounting of the blade tip.

In a particular embodiment of the invention, the upstream point is situated at the upstream end of the top edge, that is to say at the leading edge of the blade, and the downstream point is situated at the downstream end of the radially outer edge of the fin.

In the reference frame of the turbine engine, it can thus be considered that the downstream point is radially spaced towards the inside of the blade tip.

Advantageously, the aerodynamic surface is a suction-face surface, and the fin is a suction-face fin, the suction-face part of the reinforcement being more particularly subject to detachment, a detachment increased in particular by the centrifugal force for a moving blade.

Advantageously, the radially outer edge of the fin comprises an intermediate point situated between the upstream point and the downstream point and defining with the upstream point a first portion of the radially outer edge, fitting flush with the tip of the blade and, with the downstream point, a second portion of the radially outer edge spacing progressively from the tip of the blade in the direction of the trailing point.

The separation into two portions offers a good compromise between limitation of penetration of the fin in the internal abradable layer in the event of detachment of the fin, and good distribution of the forces in the event of impact of an FOD on the leading-edge reinforcement.

The intermediate point can be arranged longitudinally at equal distances from the upstream point and downstream point.

This makes it possible to protect the blade over the entire height since the first portion fits flush with the tip of the blade.

Preferably, the second portion of the radially outer edge of the suction-face fin is curved and convex. This particular form facilitates manufacture of the reinforcement and also limits the creation of disturbances in the airflow.

Advantageously, the intermediate point and the trailing point are separated from each other by a distance, measured along a median longitudinal axis of the fin, comprised between 0 and $\sin \alpha \times L \div 4$ where:

L is the length of the fin before optimisation, that is to say between the upstream point and the fictive extreme point corresponding to the symmetry of the upstream point with respect to the median axis substantially perpendicular to the longitudinal axis of the turbine engine, and passing at least through the centre of the tip of the fin, and α is the angle measured between a line passing through the upstream point and the intermediate point of the radially outer edge and a tangent to the radially outer edge, parallel to the longitudinal axis and passing through the intermediate point.

This distance also offers a good compromise between limitation of penetration of the fin in the internal abradable layer in the event of detachment of the fin, and good distribution of the forces in the event of impact of an FOD on the reinforcement of the leading edge.

Preferably, the reinforcement comprises a pressure-face fin partly covering an aerodynamic pressure-face surface of the blade.

This pressure-face fin also protects the aerodynamic pressure-face surface of the blade against FODs.

To provide good protection of the blade, the leading-edge reinforcement is produced from a metallic material.

The invention proposes, secondly, an assembly comprising a central disc on which a plurality of blades as previously described are mounted, said blades being evenly distributed around the periphery of the central disc, and extending substantially radially to the central disc.

The invention proposed, thirdly, a turbine engine comprising an assembly as previously described.

BRIEF DESCRIPTION OF THE DRAWINGS

The invention will be understood better and other details, features and advantages of the invention will emerge from a reading of the following description given by way of non-limitative example with reference to the accompanying drawings, in which.

DETAILED DESCRIPTION

Figure 1:
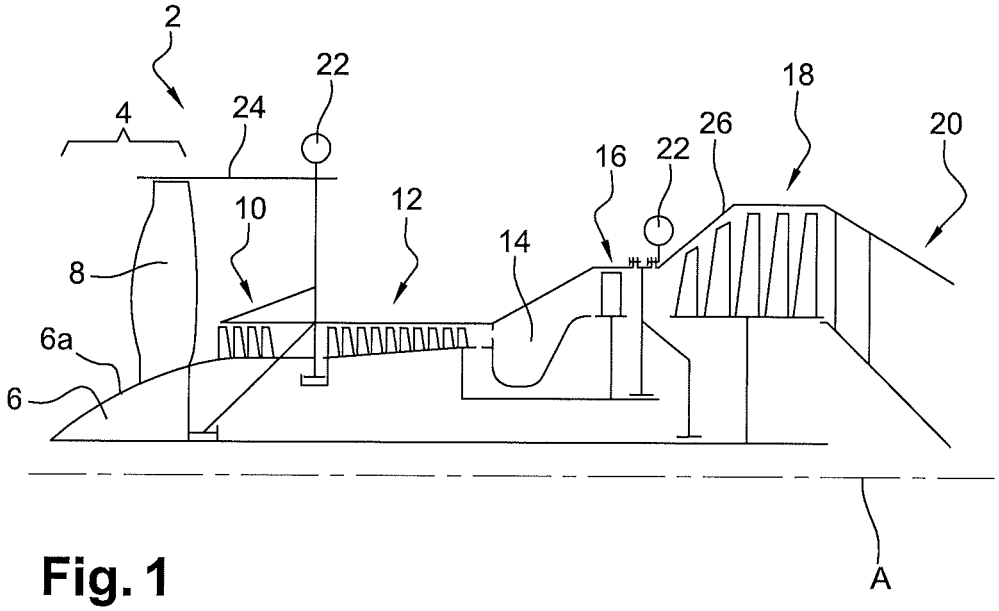
FIG. 1 is a schematic view of a turbine engine comprising an assembly having a plurality of blades.

FIG. 1 shows a turbine engine 2 having an assembly 4 comprising a central disc 6 rotatable about a longitudinal axis A of the turbine engine 2, and on which a plurality blades 8 are mounted. The blades 8 are evenly distributed around the periphery 6*a* of the central disc 6, and extending substantially radially to the central disc 6. In the present case, the assembly 4 is the fan of the turbine engine 2, and the blades 8 are the fan blades.

Conventionally, the turbine engine 2 also comprises, from upstream to downstream, and downstream of the fan, a low-pressure compressor 10, a high pressure compressor 12, a combustion chamber 14, a high-pressure turbine 16, a low-pressure turbine 18 and an exhaust casing 20. Furthermore, for attachment thereof to the aeroplane, the turbine engine 2 comprises attachment means 22, in this case two, each carried by an intermediate fan casing 24 carrying an internal abradable layer 24*a* (visible in FIG. 4), and a turbine casing 26.

In the remainder of this description, the term radial means any direction substantially perpendicular to the axis A of the turbine engine 2, the term upstream the side by means of which the air reaches a part of the turbine engine 2, and the term downstream the side through which the air moves away from said part of the turbine engine 2. The airflow direction is depicted in FIG. 2 by the arrow F.

Blade 8 means here both the moving blades (for example the rotor blades) and the fixed blades (for example the stator blades) of the turbine engines 2.

Figure 2:
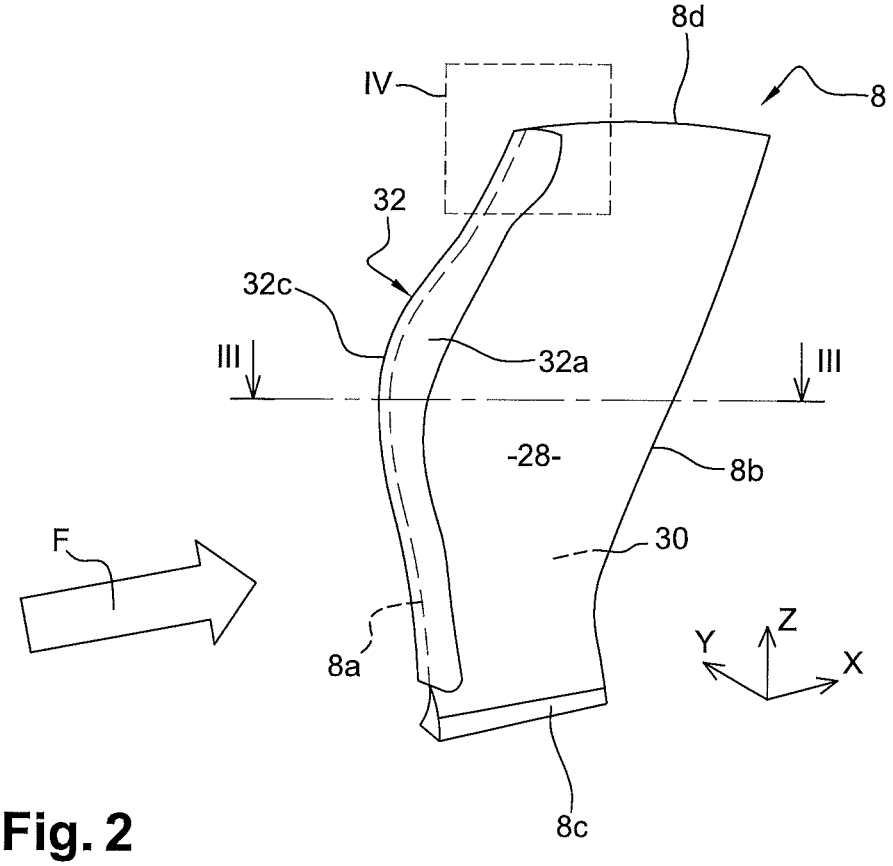
FIG. 2 is a perspective view of a blade according to the invention, in particular a fan blade, this blade carrying a leading-edge reinforcement limiting the degradation of the internal abradable layer of the turbine engine.
Figure 3:
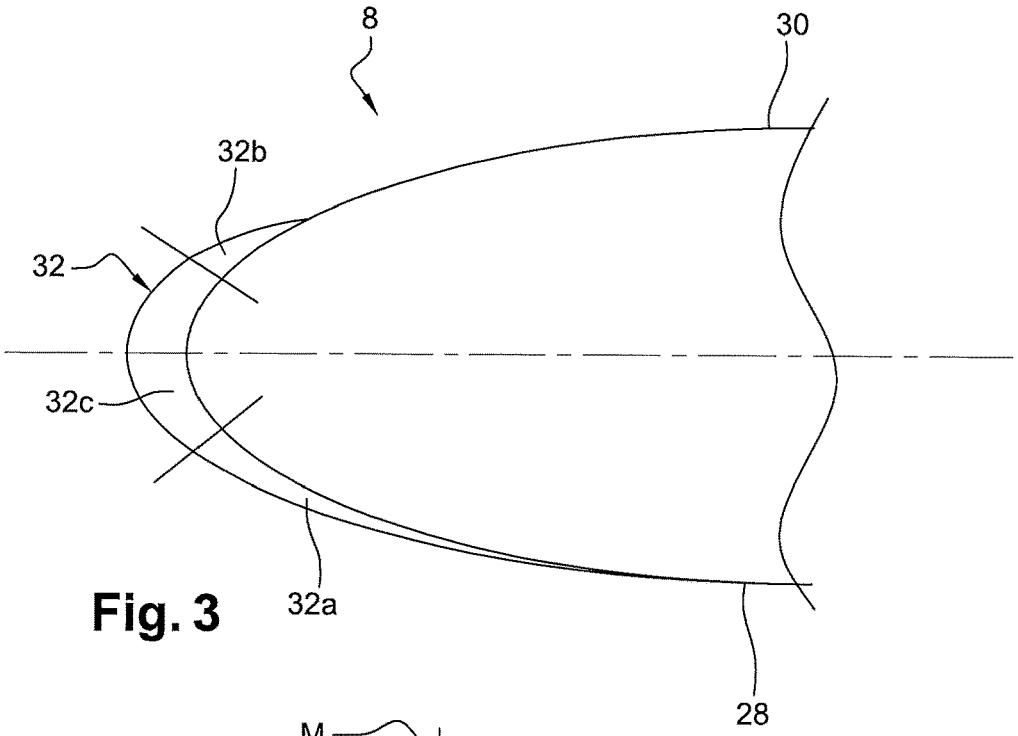
FIG. 3 is a view in cross section of the blade along the cross-sectional plane III-III in FIG. 2.

The blade 8, illustrated in perspective in FIG. 2 and in cross section in FIG. 3, comprises an aerodynamic suction-face surface 28 and an aerodynamic pressure-face surface 30 that extend in a first direction between a leading edge 8*a* and a trailing edge 8*b* of the blade 8. The blade 8 of a fan being twisted, the first direction changes in a plane XY along the cross section taken in a radial direction along the axis Z, which forms with axes X and Y an orthonormal reference frame in FIG. 2. In a second direction substantially perpendicular to the first direction, the aerodynamic suction-face surface 28 and the aerodynamic pressure-face surface 30 extend between a root 8*c* and a tip 8*d* of the blade 8.

The blade 8 also comprises a leading-edge reinforcement 32 comprising a suction-face fin 32*a* partly covering the aerodynamic suction-face surface 28 of the substantially radial blade 8, and a pressure-face fin 32*b* partly covering the aerodynamic pressure-face surface 30 of the blade 8. These two fins 32*a*, 32*b* have, as can be seen in FIG. 3, a cross section that becomes thinner from upstream to downstream.

The two fins 32*a*, 32*b* are joined by a leading edge 32*c* that covers the leading edge 8*a* of the blade 8 and, in cross section, has thickness greater than the maximum thickness of the fins 32*a*, 32*b*.

As can be seen in FIG. 2, the reinforcement 32 of the leading edge 8*a* of the blade 8 extends substantially from the root 8*c* of the blade 8 as far as its tip 8*d*.

The leading-edge reinforcement 32 is preferably produced from a high-strength metallic material, such as for example a titanium alloy.

Figure 4:
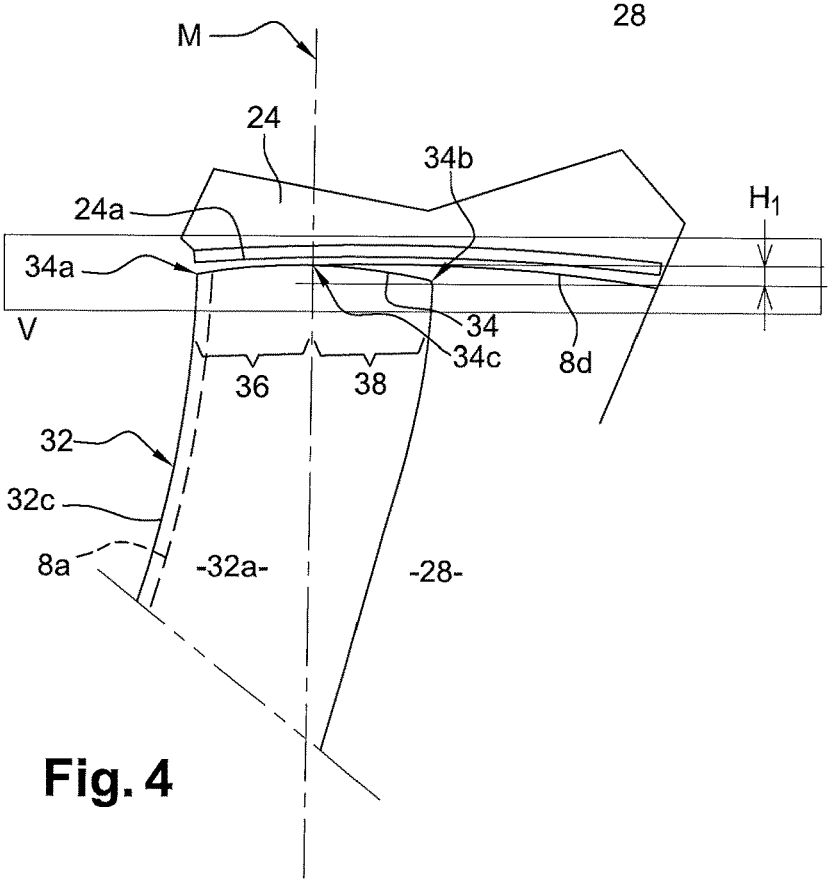
FIG. 4 is a detail view of a top portion of a blade in accordance with the inset IV in FIG. 2.

The detail view in FIG. 4 shows a particularity of the suction-face fin 32*a* of the leading-edge reinforcement 32. Indeed, the suction-face fin 32*a* has a radially outer edge 34 (also referred to as the top edge) arranged in the vicinity of the tip 8*d* of the blade and which extends from the leading edge 8*a* to the trailing edge 8*b* (FIG. 2). This radially outer edge 34 comprises an upstream point 34*a* that fits flush with the tip 8*d* of the blade 8 at the leading edge 8*a* and a downstream point 34*b* that is spaced from the tip 8*d* of the blade 8. The term "upper" extends according to, the orientation in FIG. 4. In other words the radially outer edge 34 is disposed radially externally with respect to the axis A of the turbine engine 2.

It should be understood that the upstream point 34*a* is arranged on the same side as the leading edge 8*a* of the blade 8 and the downstream point 34*b* is arranged on the same side as the trailing edge 8*b* of the blade 8 in the direction F of airflow (FIG. 2) on the blade 8 from the leading edge 8*a* to the trailing edge 8*b*.

Furthermore, the upper radially outer edge 34 of the suction-face fin 32*a* comprises an intermediate point 34*c* situated between the upstream point 34*a* and the downstream point 34*b* and defining with the upstream point 34*a* a first portion 36 of the radially outer edge, fitting flush with the tip 8*d* of the blade 8 and, with the downstream point 34*b*, a second portion 38 of the upper edge moving away gradually from the tip 8*d* of the blade 8. The connection of the first portion 36 of the radially outer edge 34 with the second portion 38 of the upper edge is substantially tangential.

According to one aspect, the intermediate point 34*c* is arranged at equal distances from the upstream point 34*a* and the downstream point 34*b*, in an axial direction parallel to the longitudinal axis A. However, the intermediate point 34*c* could be closer to the upstream point 34*a* or to the downstream point 34*b*.

Figure 5:
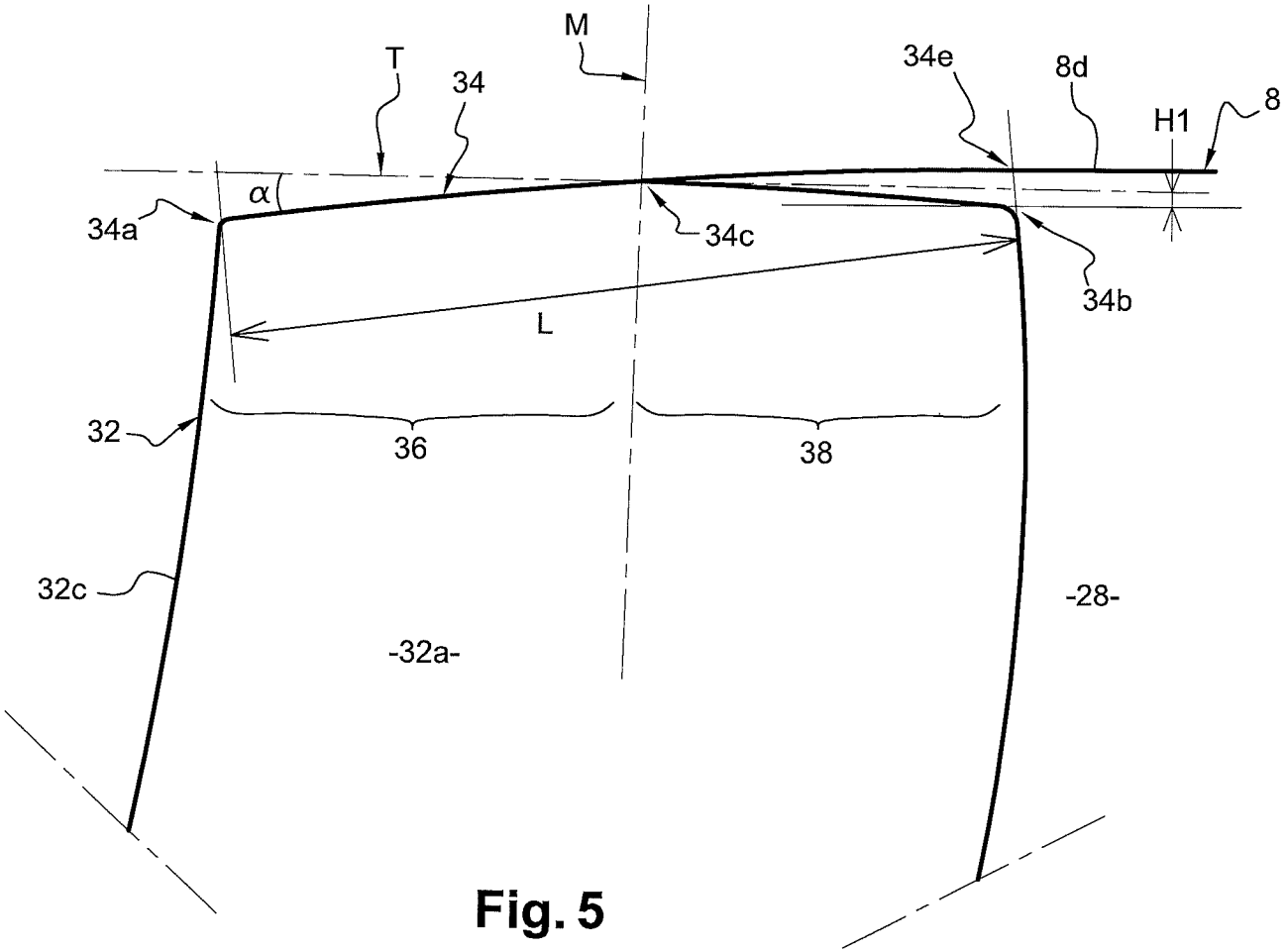
FIG. 5 is a detail view to an enlarged scale of the detail V in FIG. 4.

FIG. 5 shows a fictive extreme point 34*e* corresponding to the symmetry of the upstream point 34*a* with respect to a median axis M substantially perpendicular to the axis A of the turbine engine 2, and passing at least through the centre of the tip of the suction-face fin 32*a*. This fictive extreme point 34*e* corresponds to an extreme point of the suction-face fin 32*a* before optimisation thereof.

Advantageously, this extreme point 34*e* makes it possible to define the gradual separation of the downstream point 34*b* with respect to the tip 8*d* of the blade 8.

The spacing of second portion 38 of the radially outer edge 34 of the suction-face fin 32*a* is preferably curved and convex. In other words, the second portion 38 has substantially a curved shape that spaces continuously from the tip 8*d* of the blade 8 in the direction of the root 8*c* (FIG. 2) thereof, and this from upstream to downstream.

However, according to variant embodiments not shown in the figures, the second portion 38 of the radially outer edge 34 of the suction-face fin 32*a* could be rectilinear or on the other hand comprise an alternation of protrusions and hollows.

According to a preferred embodiment shown in FIG. 5, the intermediate point 34*c* and the downstream point 34*b* are separated from each other by a distance H1 measured along the longitudinal median axis M, that is to say in the radial direction Z, H1 being between 0 and $\sin \alpha \times L \div 4$ where:

L is the length of the fin 32*a* before optimisation, that is to say between the upstream point 34*a* and the fictive point 34*e*, and $\alpha$ is the angle measured between a line passing through the upstream point 34*a* and the intermediate point 34*c* on the radially outer edge 34 and a tangent T to said radially outer edge 34, parallel to the longitudinal axis A of the turbine engine 2 and passing through the intermediate point 34*c*.

The distance L, the tangent T and the angle $\alpha$ are illustrated in FIG. 5.

Thus, in the event of impact of an FOD on the leading-edge reinforcement 32, if the suction-face fin 32*a* detaches, it will not come into contact with the internal abradable layer 24*a* carried by the intermediate fan casing 24. Consequently it will be necessary only to repair the blade 8 that has been impacted (or the impacted blades 8), which is simpler, quicker and less expensive that complete immobilisation of the turbine engine 2 for replacing the impacted blade 8 (or impacted blades 8) of the intermediate fan casing 24 and its internal abradable layer 24*a*.

For reasons of simplicity in manufacture of the reinforcement 32 of the leading edge, the pressure-face fin 32*b* also comprises a top edge having an upstream point fitting flush with the tip 8*d* of the blade 8 and a downstream point distant from the upstream point and spaced from the tip 8*d* of the blade 8, that is to say radially distant internally.

The top edge of the pressure-face fin 32*b* may also comprise an intermediate point situated between the leading point and the trailing point and defining with the leading point a first portion of the top edge, fitting flush with the tip 8*d* of the blade 8 and, with the trailing point, a second portion of the top edge spacing gradually from the tip 8*d* of the blade 8 in the direction of the root 8*c*.

However, the forms and dimensions of the portions of the pressure-face 32*b* are smaller compared with the forms and dimensions of the portions 36, 38 of the top edge 34 of the suction-face fin 32*a*.

Thus an asymmetric reinforcement 32 will be obtained.

The invention claimed is:

1. A turbine engine blade extending along a longitudinal axis, comprising an aerodynamic surface that extends in a first direction between a leading edge and a trailing edge, and in a second direction substantially perpendicular to the first direction between a root and a tip of the blade, and a leading-edge reinforcement comprising a fin partly covering the aerodynamic surface of the blade, wherein the fin has a radially outer edge arranged in the vicinity of the tip of the blade and extending between the leading edge and the trailing edge, the radially outer edge comprising an upstream point fitting flush with the tip of the blade at the leading edge and a downstream point spaced radially from the tip of the blade.

2. The turbine engine blade of claim 1, wherein the aerodynamic surface is a suction-face surface, and the fin is a suction-face fin.

3. The turbine engine blade of claim 1, wherein the radially outer edge of the fin comprises an intermediate point situated between the upstream point and the downstream point and defining with the upstream point a first portion of the radially outer edge, fitting flush with the tip of the blade and, with the downstream point, a second portion of the radially outer edge separating gradually from the tip of the blade in the direction of the downstream point.

4. The turbine engine blade of claim 3, in which the intermediate point is arranged longitudinally at equal distances from the upstream point and from the downstream point.

5. The turbine engine blade of claim 3, wherein the second portion of the radially outer edge of the fin is curved and convex.

6. The turbine engine blade of claim 3, wherein the intermediate point and the downstream point are separated from each other by a distance, measured along a median longitudinal axis of the fin, between 0 and $\sin \alpha \times L \div 4$, where:

L is a length of the fin before optimization, between the upstream point and a fictive extreme point corresponding to a symmetry of the upstream point with respect to the median longitudinal axis substantially perpendicular to the longitudinal axis of the turbine engine, and passing at least through the center of the tip of the fin, and $\alpha$ is the angle measured between a line passing through the upstream point and the intermediate point of the radially outer edge and a tangent to the radially outer edge, parallel to the longitudinal axis and passing through the intermediate point.

7. The turbine engine blade of claim 1, wherein the leading-edge reinforcement comprises a pressure-face fin partly covering an aerodynamic pressure-face surface of the blade.

8. The turbine engine blade of claim 1, wherein the leading-edge reinforcement is produced from a metallic material.

9. An assembly comprising a central disc on which a plurality of turbine engine blades according to claim 1 are mounted, said blades being evenly distributed around a periphery of the central disc, and extending substantially radially with respect to the central disc.

10. A turbine engine comprising the assembly of claim 9.

* * * * *